United States Patent [19]

Satoh

[11] Patent Number: 4,962,536

[45] Date of Patent: Oct. 9, 1990

[54] MULTI-PULSE VOICE ENCODER WITH PITCH PREDICTION IN A CROSS-CORRELATION DOMAIN

[75] Inventor: Yayoi Satoh, Tokyo, Japan

[73] Assignee: NEC Corporation, Tokyo, Japan

[21] Appl. No.: 329,832

[22] Filed: Mar. 28, 1989

[30] Foreign Application Priority Data

Mar. 28, 1988 [JP] Japan ..... 63-71805

[51] Int. Cl.[5] ..... G10L 5/00

[52] U.S. Cl. ..... 381/49

[58] Field of Search ..... 381/49

[56] References Cited

U.S. PATENT DOCUMENTS 4,776,015 10/1988 Takeda et al. ..... 381/49

OTHER PUBLICATIONS

Ozawa et al., "High Quality Multi-Pulse Speech coder with Pitch Prediction", Proceedings of ICASSP 86 (IEEE-IECEJ-ASJ International Conference on Acoustics, Speech, and Signal Processing), Article No. 33.3, Apr. 10, 1986, pp. 1689-1692.

*Primary Examiner*—Emanuel S. Kemeny

*Attorney, Agent, or Firm*—Foley & Lardner, Schwartz, Jeffery, Schwaab, Mack, Blumenthal & Evans

[57] ABSTRACT

In a pulse searching arrangement (65) of a multi-pulse voice encoder comprising a linear prediction residual signal producing arrangement (61), a pitch period is predicted in a cross-correlation domain in each subframe of a frame of an input voice signal. For this purpose, a local signal producing circuit comprises a first cross-correlator (66) for producing a first cross-correlation signal related to a linear prediction residual signal. A buffer memory (32) produces an output cross-correlation signal from subframe to subframe. Supplied with a sum signal and controlled by a pitch period signal representative of pitch periods of the input voice signal, a pitch synthesizing filter (71) produces a synthesized signal, which is added to provide the sum signal to a signal representative of excitation pulses. Responsive to the synthesized signal, a second cross-correlator (67) produces a second cross-correlation signal, which is subtracted from the output cross-correlation signal to provide the local signal. Supplied with an autocorrelation signal, a pulse searcher (44) searches the excitation pulses in the local signal.

3 Claims, 8 Drawing Sheets

MULTI-PULSE VOICE ENCODER WITH PITCH PREDICTION IN A CROSS-CORRELATION DOMAIN

BACKGROUND OF THE INVENTION

This invention relates to a multi-pulse voice or speech encoder.

Various multi-pulse voice encoders are already known. For example, a plurality of multi-pulse voice encoders are described in an article read Apr. 10, 1986, by Kazunori Ozawa and Takashi Araseki, both of research laboratiries of the present assignee, and recorded in the proceedings of "ICASSP 86" (IEEE-IECEJ-ASJ International Conference on Acoustics, Speech, and Signal Processing) as article No. 33.3 under the title of "High Quality Multi-Pulse Speech Coder with Pitch Prediction". Another multi-pulse voice encoder is disclosed in U.S. patent application Ser. No. 74,193 filed July 16, 1987, by Yayoi Satoh, the present inventor, et al and assigned to the instant assignee.

Such a multi-pulse voice encoder has an encoder input terminal supplied with an input voice or speech signal which is digitized at a sampling period of, for example, 8 kHz. Besides an encoder output terminal, the voice encoder has an intermediate terminal in the manner which will later be described more in detail. An excitation pulse signal is delivered to the intermediate terminal to represent the input voice signal. It should be noted in this connection for the time being that the input and the intermediate terminals will not be mentioned on briefly describing one of the voice encoders of the Ozawa et al article and the voice encoder of the Satoh et al patent application.

It will later be described more in detail that one of the multi-pulse voice encoders of the Ozawa et al article comprises an analyzing arrangement for analyzing an input voice signal into feature parameters, such as partial correlation (parcor) coefficients, to produce a feature parameter signal representative of the feature parameters. An extracting arrangement extracts pitch periods from the input voice signal to produce a pitch period signal representative of the pitch periods. A pulse searching arrangement is supplied with the feature parameter signal and the pitch period signal. Supplied furthermore with the input voice signal, the pulse searching arrangement searches excitation pulses or sound source pulses representative of the input voice signal in each pulse search duration or interval determined with reference to the pitch periods. The pulse searching arrangement thereby produces an excitation pulse signal representative of the excitation pulses searched in the pitch periods, namely, throughout the input voice signal.

In practice, each frame of the input voice signal is divided into a plurality of subframes with reference to the pitch periods. More particularly, each subframe is either one pitch period long or one pitch period less several sampling periods long. In the excitation pulse signal, one of the excitation pulses may appear at a point between two consecutive frames or at a point between two consecutive subframes. Pulse search is therefore carried out by the pulse searching arrangement as regards the input voice signal of the pulse search duration which is equal to one subframe period plus an impulse response length of the analyzing arrangement.

It will later be described also more in detail that the multi-pulse voice encoder of the Satoh et al patent application comprises an analyzing arrangement which is similar to that used in the above-described voice encoder of the Ozawa et al article and produces a feature parameter signal representative of feature parameters of an input voice signal. A residual signal producing arrangement is controlled by the feature parameter signal. Supplied with each frame of the input voice signal, the residual signal producing arrangement produces a prediction residual signal related to the frame being dealt with. Supplied with the feature parameter signal and the prediction residual signal, a pulse searching arrangement searches excitation pulses representative of the input voice signal in the frame under consideration and produces an excitation pulse signal representative of the excitation pulses searched for the input voice signal, namely, in a succession of the frames.

In the Satoh et al encoder, the frame is not divided into subframes. Like in the above-described pulse searching arrangement of the Ozawa et al article, the pulse search is carried out in connection with the input voice signal of a pulse search duration which is equal to one frame period plus an overlap interval or duration. Although nothing is mentioned in the Satoh et al patent application, each frame may be divided into subframes with reference to the pitch periods. In this event, the pulse search duration should be equal to one subframe period plus the impulse response length.

The pulse searching arrangement of the above-described encoder of the Ozawa et al article comprises a pitch prediction filter for predicting the pitch period in a wave form domain or on a wave form level. A pitch prediction residual signal is produced in the pulse searching arrangement by using the predicted pitch period and the input voice signal and is used in the pulse search. In contrast, the prediction residual signal is a linear prediction residual signal in the Satoh et al encoder.

When the pitch prediction filter predicts the pitch period in the wave form domain, the excitation pulse signal must be used in the pulse searching arrangement to produce a reproduced voice signal in each subframe. If the input voice signal is processed frame by frame, a boundary between two consecutive frames must be processed by using the overlap interval. For this purpose, memories of a large total memory capacity must be included here and there in the voice encoder. If the input voice signal is processed subframe by subframe, a boundary between two consecutive subframes must be processed by using the impulse response length as a similar overlap interval. Depending on the pitch periods, the subframe period may become shorter than the impulse response length. This makes it difficult to search the excitation pulses. In other words, a long-continued processing time becomes necessary to search the excitation pulses. As a result, hardware of a large scale becomes indispensable.

SUMMARY OF THE INVENTION

It is therefore an object of the present invention to provide a multi-pulse voice or speech encoder, in which it is unnecessary to carry out pitch prediction in a wave form domain.

It is another object of this invention to provide a multi-pulse voice encoder of the type described, which is for encoding an input voice or speech signal subframe by subframe and in which it is unnecessary to form a reproduced voice signal in each subframe.

Other objects of this invention will become clear as the description proceeds.

On describing the gist of this invention, it is possible to understand that a voice encoder has an encoder input terminal supplied with an input voice signal and an intermediate terminal to which an excitation pulse signal is delivered to represent the input voice signal. The voice encoder comprises analyzing means for analyzing the input voice signal into feature parameters to produce a feature parameter signal representative of the feature parameters, extracting means connected to the input terminal for extracting pitch periods from the input voice signal to produce a pitch signal representative of the pitch periods, residual signal producing means connected to the input terminal and controlled by the feature parameter signal for producing a prediction residual signal related to the input voice signal, and pulse searching means connected to the intermediate terminal and supplied with the feature parameter signal, the pitch period signal, and the prediction residual signal for searching excitation pulses representative of the input voice signal in each of pulse search durations determined with reference to the pitch periods. The pulse searching means thereby produces the excitation pulses in the pitch periods to deliver the excitation pulse signal to the intermediate terminal.

According to this invention, the pulse searching means comprises (a) local signal producing means connected to the intermediate terminal and the residual signal producing means and controlled by the feature parameter signal and the pitch period signal for producing a local signal related to the prediction residual signal in each of the pulse search durations and (b) a pulse searching circuit connected to the intermediate terminal and supplied with the feature parameter signal, the pitch period signal, and the local signal for searching the excitation pulses in the pulse search durations to deliver the excitation pulse signal to the intermediate terminal.

DESCRIPTION OF THE PREFERRED EMBODIMENT

Figure 1:
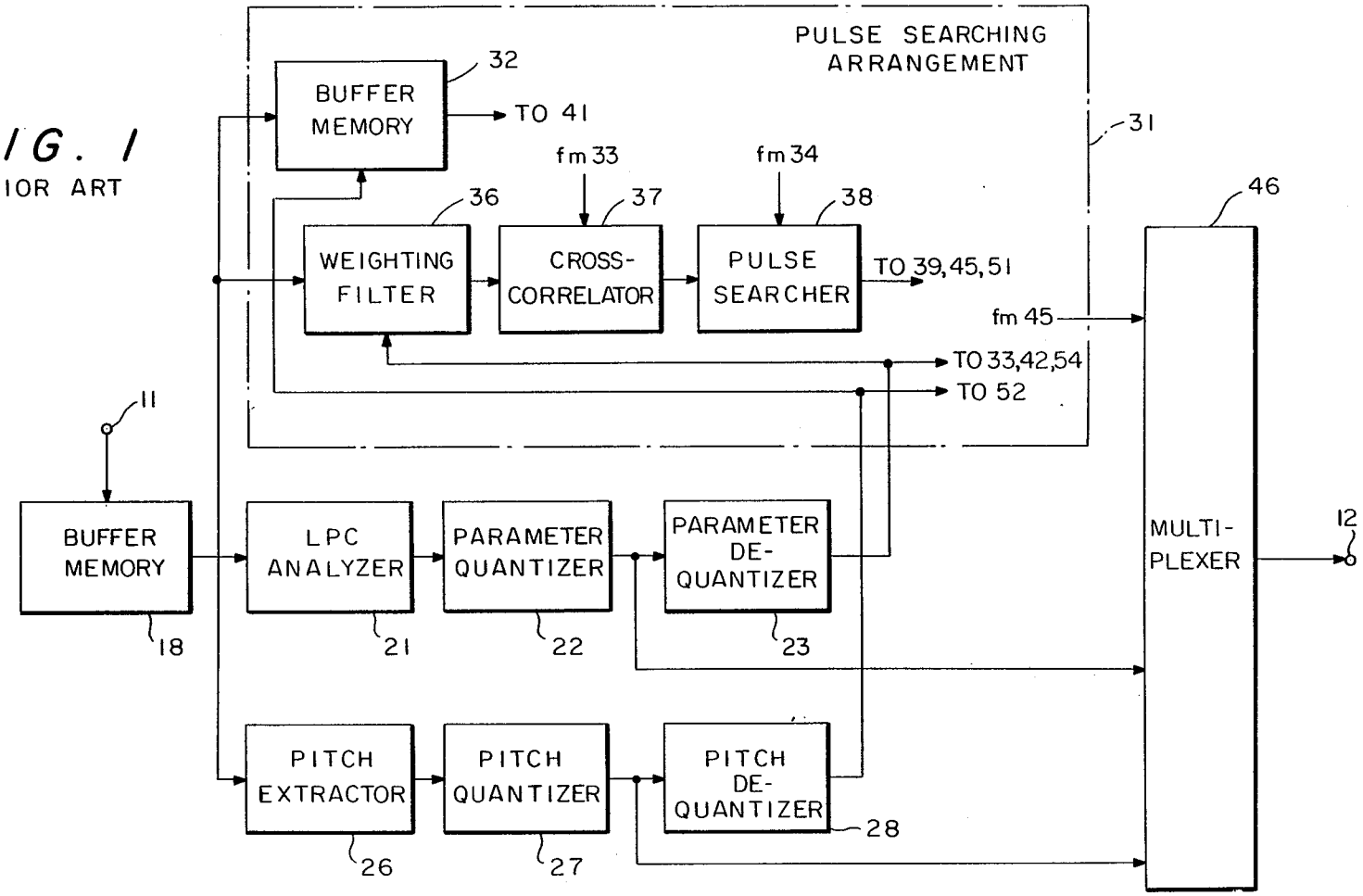
FIG. 1 PRIOR ART
FIG. 1 is a block diagram of a conventional voice encoder.
Figure 2:
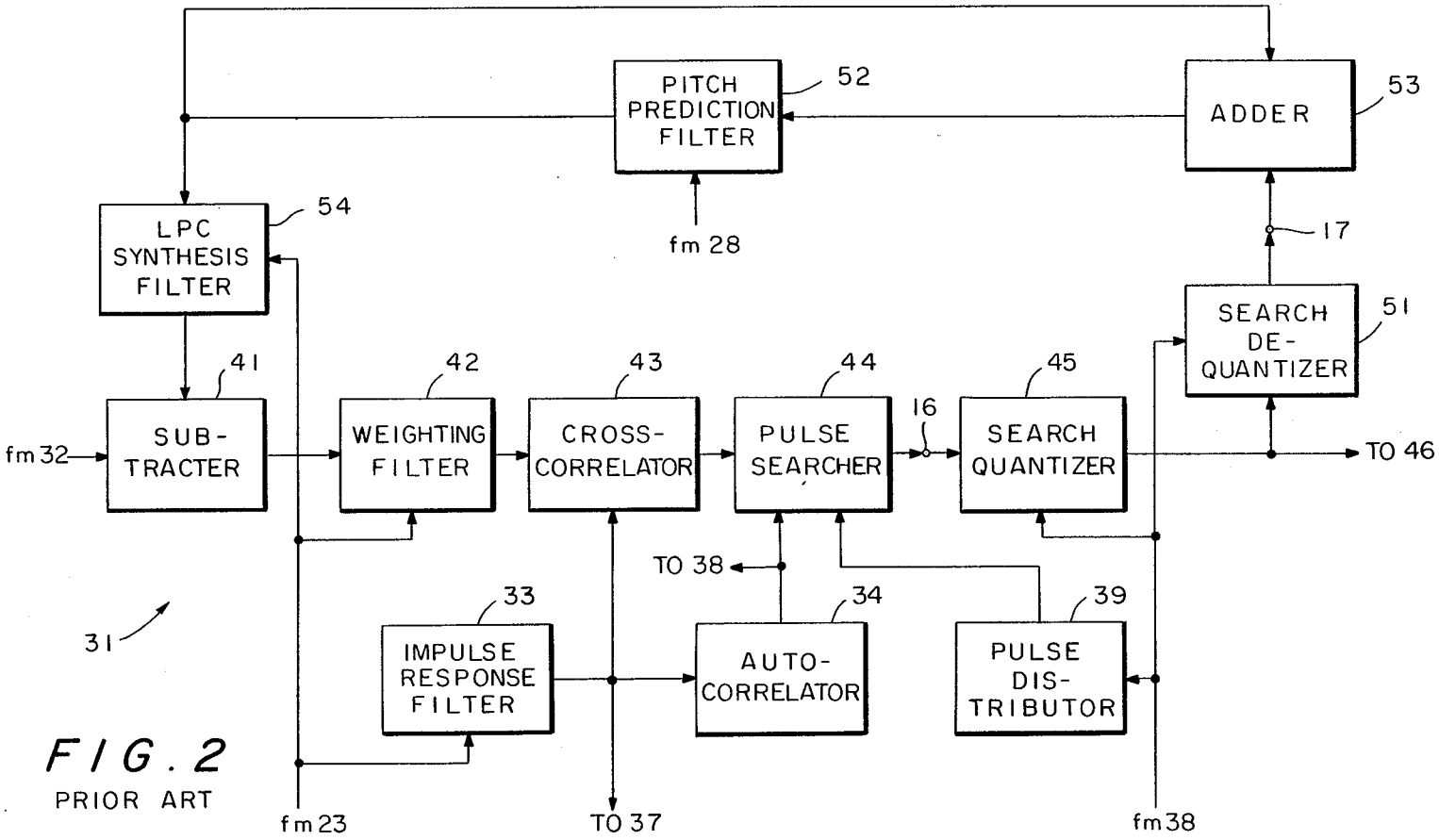
FIG. 2 PRIOR ART
FIG. 2 is a detailed block diagram of a part of the voice encoder illustrated in FIG. 1.

Referring to FIGS. 1 and 2, a conventional multi-pulse voice or speech encoder will be described at first in order to facilitate an understanding of the present invention. The voice encoder is of the type which is briefly described as an MPC-PO (multi-pulse speech coder with pitch prediction outside pulse search procedure) with reference to FIG. 5 of the Ozawa et al article referred to hereinabove.

In FIGS. 1 and 2, the voice encoder has encoder input and output terminals 11 and 12 and first and second intermediate terminals 16 and 17. After digitized at a sampling period of, for example, 8 kHz, an input voice or speech signal is supplied to the encoder input terminal 11. In the manner which is known in the art and will become clear as the description proceeds, an excitation pulse signal is delivered to the first intermediate terminal 16.

In FIG. 1, a main buffer memory 18 is for buffering the input voice signal as a buffered voice signal and produces the buffered voice signal as a buffer output signal frame by frame of the input voice signal in the manner known in the art. Each frame may have a frame period of 20 milliseconds.

Supplied with each frame of the buffer output signal from the main buffer memory 18, a linear prediction coding (LPC) analyzer 21 analyzes the buffer output signal into feature parameters, such as the partial correlation (parcor) coefficients, and produces a feature parameter signal representative of the feature parameters. Although not separately depicted, a weighting filter is included in the linear prediction coding analyzer 21 in order to reduce the perceptual distortion in the manner known in the art. It should be noted in this connection that the weighting filter has an impulse response length.

The feature parameter signal is quantized by a parameter quantizer 22 into a quantized parameter signal, which is dequantized or inversely quantized by a parameter dequantizer 23 into a dequantized parameter signal. A combination of the linear prediction coding analyzer 21 and the parameter quantizer and dequantizer 22 and 23 serves as an analyzing arrangement for analyzing the input voice signal into the feature parameters to produce the dequantized parameter signal which is substantially identical with the feature parameter signal and may be so called. It is possible to understand that the analyzing arrangement has the impulse response length.

Supplied with each frame of the buffer output signal, a pitch extractor 26 extracts pitch periods from the input voice signal to produce an output pitch signal representative of the pitch periods. The pitch period is variable, for example, between 2 and 5 milliseconds depending on a speaker from whose utterance the input voice signal is derived. It is known in the art that pitch prediction filter coefficients are determined by the pitch extractor 26 and are represented by the output pitch signal. The fact should be noted in connection with voice encoders herein described that the pitch period is variable only at a point between two consecutive ones of the frames.

A pitch quantizer 27 quantizes the output pitch signal into a quantized pitch signal, which is dequantized by a pitch dequantizer 28 into a dequantized pitch signal. A combination of the buffer memory 18, the pitch extractor 26, and the pitch quantizer and dequantizer 27 and 28 is connected to the encoder input terminal 11 and serves as an extracting arrangement for extracting the pitch periods from the input voice signal to produce the dequantized pitch signal which is substantially identical with the output pitch signal. Either the output pitch signal or the dequantized pitch signal represents, among others, the pitch periods and is herein called a pitch period signal.

In FIGS. 1 and 2, a pulse searching arrangement 31 comprises a subsidiary buffer memory 32 supplied with the buffer output signal from the main buffer memory 18 to buffer each frame of the buffer output signal as a buffered frame. Controlled by the dequantized pitch signal, the subsidiary buffer memory 32 produces such buffered frames as a duration signal which successively represents such buffered frames in pulse search durations or intervals determined in each frame with reference to the pitch period of the frame under consideration. More particularly, each frame is divided into several subframes which may or may not have a common subframe period. For example, some of the subframes may have a subframe period of the pitch period. At least one remaining subframe may have a shorter subframe period which is equal to one pitch period less several sampling periods. Each pulse search duration is equal to the subframe period plus the impulse response length.

In FIG. 2, an impulse response filter 33 is connected to the parameter dequantizer 23 in the pulse searching arrangement 31 and supplied with the parameter dequantized signal to produce a coefficient signal representative of impulse response coefficients of a weighting synthesis filter. Responsive to the coefficient signal, an autocorrelator 34 calculates autocorrelation factors of the impulse response coefficients to produce an autocorrelation signal representative of the autocorrelation factors.

In FIGS. 1 and 2, the pulse searching arrangement 31 comprises a distributor weighting filter 36 supplied with the buffer output signal from the main buffer memory 18 and controlled by the dequantized parameter signal. The distributor weighting filter 36 thereby produces a distributor weighted signal which represents a weighted voice signal of a frame being dealt with. A distributor cross-correlator 37 is supplied with the coefficient signal and the distributor weighted signal to produce a distributor cross-correlation signal representative of cross-correlation factors between the impulse response coefficients of the frame in question and the weighted voice signal.

Supplied with the autocorrelation signal and the distributor cross-correlation signal, a distributor pulse searcher 38 searches distributor pulses representative of the weighted voice signal of the frame under consideration to produce a distributor pulse signal representative of the distributor pulses. Responsive to the distributor pulse signal, a pulse distributor 39 calculates pulse counts of excitation pulses or sound source pulses which should be searched by the pulse searching arrangement 31 in the pulse search durations of the frame in question. The pulse distributor 39 thereby produces a pulse count signal representative of the pulse counts.

In this manner, a combination of circuit elements 36 through 39 serves as a pulse distributing circuit for producing the pulse count signal. The distributor pulse searcher 38 additionally produces a miximum amplitude signal representative of a maximum amplitude of the distributor pulses in each frame.

Incidentally, a predetermined number of excitation pulses may be searched in each frame of the input voice signal. The predetermined number depends on the bit rate at which codes representative of the excitation pulses should be produced from the multi-pulse voice encoder. When the predetermined number is, for example, ten and when each frame should be divided into four subframes, it is possible to distribute three excitation pulses in each of two preceding subframes and two excitation pulses in each of two following subframes.

In FIG. 2, a subtracter 41 is connected to the subsidiary buffer memory 32 to calculate the duration signal minus a reproduced voice signal produced in connected with each pulse search duration in the manner which will presently be described. The subtracter 41 thereby produces a pitch prediction residual signal. Controlled by the dequantized parameter signal supplied from the parameter dequantizer 23, a search weighting filter 42 produces a search weighted signal representative of a weighted duration signal. Responsive to the search weighted signal and supplied with the coefficient signal from the impulse response filter 33, a search cross-correlator 43 produces a search cross-correlation signal representative of cross-correlation factors between the impulse response coefficients for the pulse search duration in question and the weighted duration signal.

Responsive to the search cross-correlation signal and supplied with the autocorrelation signal from the autocorrelator 34 and with the pulse distribution signal from the pulse distributor 39, a main pulse searcher 44 searches excitation pulses representative of the input voice signal in each pulse search duration to supply the first intermediate terminal 16 with an excitation pulse signal representative of the excitation pulses searched in the pitch periods, namely, throughout the input voice signal. A search quantizer 45 quantizes the excitation pulse signal into a quantized pulse signal, which is delivered as the above-mentioned codes to a multiplexer 46 depicted in FIG. 1. The main pulse searcher 44 will hereafter be referred to simply as a pulse searcher.

In FIG. 1, the quantized parameter signal and the quantized pitch signal are also supplied to the multiplexer 46. A multiplexed signal is delivered from the multiplexer 46 to the encoder output terminal 12 and thence to a counterpart multi-pulse voice decoder (not shown).

In FIG. 2, the pulse searching arrangement 31 comprises a search dequantizer 51 for dequantizing the quantized pulse signal into a dequantized pulse signal, which is substantially identical with the excitation pulse signal and may be so called. The dequantized pulse signal is delivered to the second intermediate terminal 17. Inasmuch as the dequantized pulse signal is substantially identical with the excitation pulse signal, it is possible to understand that the excitation pulse signal is supplied to the second intermediate terminal 17 which may alternatively be referred to simply as an intermediate terminal.

In the pulse searching arrangement 31, a pitch prediction filter 52 is controlled by the dequantized pitch signal which is supplied from the pitch dequantizer 38 to represent the pitch period in a preceding frame preceding a current frame being dealt with. In the current frame, the pitch prediction filter 52 produces a pitch prediction signal in response to a sum signal supplied from an adder 53. The sum signal represents a sum of the pitch prediction signal and the dequantized pulse signal. The pitch prediction signal is delivered to a linear prediction coding synthesizing filter 54 which is controlled by the dequantized parameter signal supplied from the parameter dequantizer 23. The synthesizing filter 54 thereby produces the reproduced voice signal. Incidentally, it is known in the art that the search quantizer 45 and the search dequantizer 51 are controlled by the maximum amplitude signal supplied from the distributor pulse searcher 38.

Reviewing FIGS. 1 and 2, it is now understood that the pulse searching arrangement 31 is supplied with the input voice signal from the main buffer memory 18 directly and through a combination of circuit elements 36 to 39, with the feature parameter signal from the parameter dequantizer 23, and with the pitch period signal from the pitch dequantizer 28 and searches the excitation pulses representative of the input voice signal in each pulse search duration. The pulse searching arrangement 31 thereby supplies the intermediate terminal 17 with the excitation pulse signal representative of the excitation pulses searched in the pitch periods, namely, throughout the input voice signal.

Figure 3:
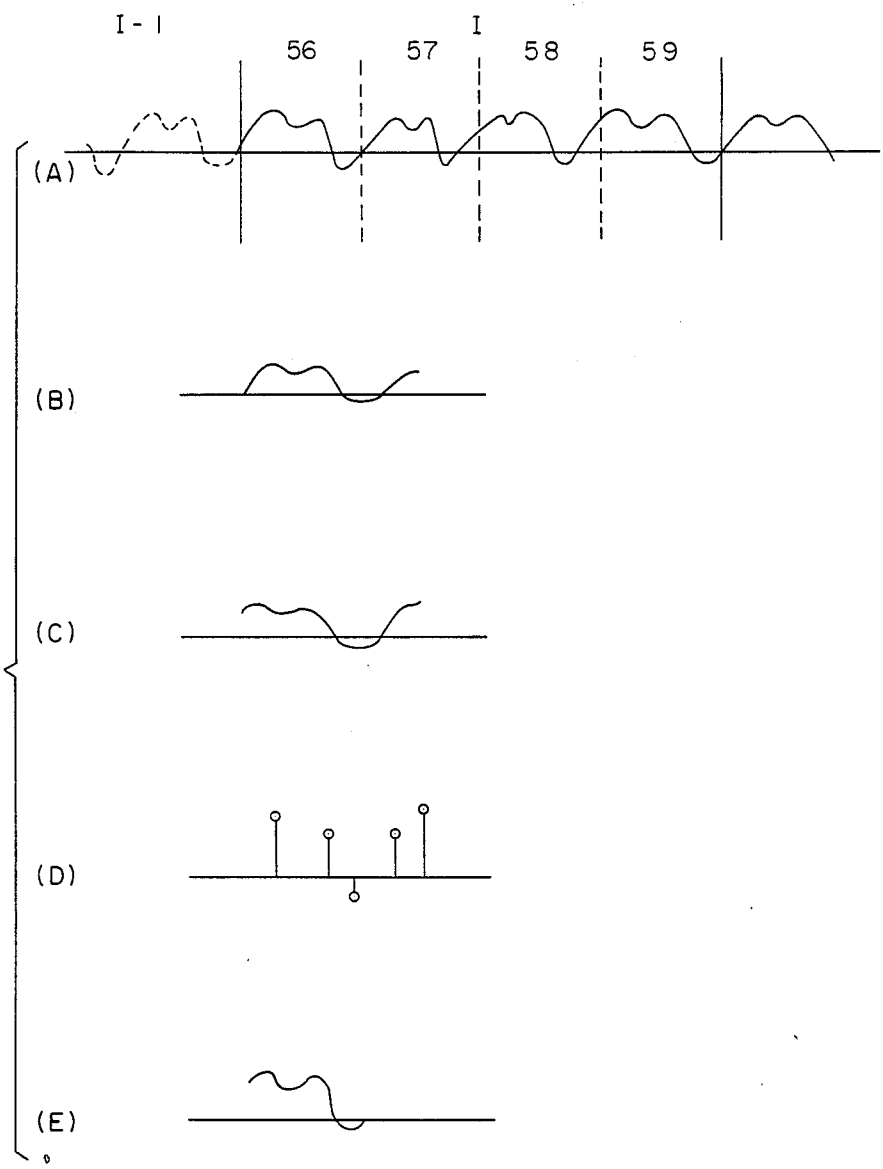
FIG. 3 PRIOR ART
FIG. 3 shows wave forms of signals which appear in the voice encoder depicted in FIGS. 1 and 2.

Turning to FIG. 3, let it be assumed that an I-th frame of the input voice signal is produced from the main buffer memory 18 and is divided into first through fourth subframes 56, 57, 58, and 59 having a common subframe period which is M sampling periods long. Along a top or first line labelled (A), the input voice signal of the I-th frame is exemplified by a solid-line curve. A part of the reproduced voice signal of an (I-1)-th frame is exemplified by a dashed-line curve leftwardly of the input voice signal of the I-th frame. Incidentally, it is presumed that the impulse response length is equal to L sampling periods. The pulse search duration is therefore M sampling periods plus L sampling periods.

For the input voice signal of the first subframe 56 plus the impulse response length, the pitch prediction residual signal is depicted along a second line labelled (B). The search cross-correlation signal is shown along a third line labelled (C). The excitation pulses are exemplified along a fourth line labelled (D). The reproduced voice signal of the I-th frame is exemplified along a fifth or bottom line labelled (E).

Figure 4:
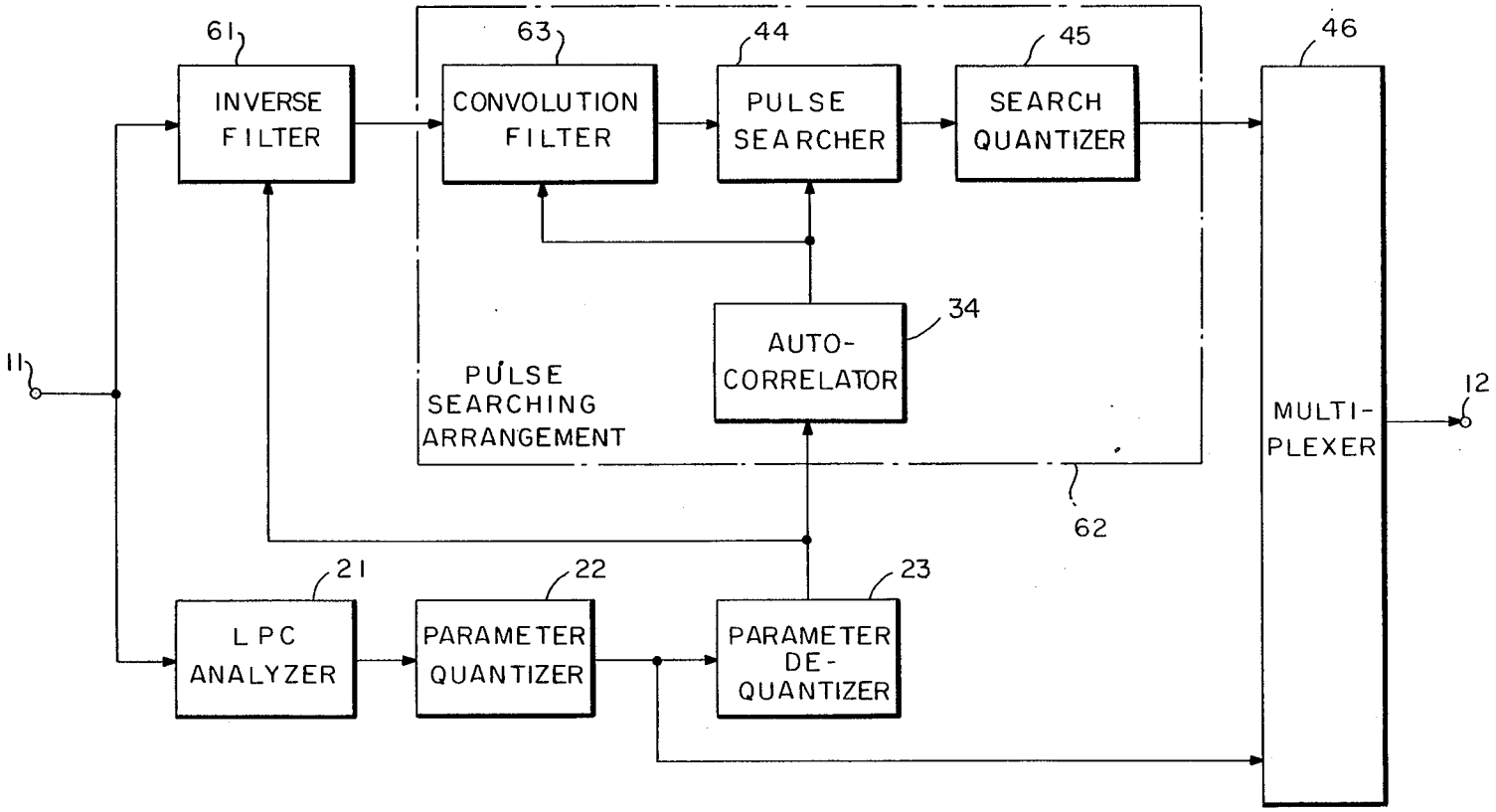
FIG. 4 PRIOR ART
FIG. 4 is a simplified block diagram of another conventional voice encoder.

Referring to FIG. 4, another conventional multipulse voice encoder will be described in order to further facilitate the understanding of this invention. The voice encoder is what is revealed in the Satoh et al patent application cited heretobefore and comprises similar parts which are designated by like reference numerals. The voice encoder does not include the extracting arrangement comprising circuit elements 26 through 28. The main buffer memory 18 is not depicted merely for simplicity of the illustration.

An inverse filter 61 is connected to the encoder input terminal 11 to be supplied with the buffer output signal frame by frame and to the parameter dequantizer 23 to be controlled by the dequantized parameter signal representative of filter coefficients of the linear prediction coding analyzer 21. The inverse filter 61 thereby serves as a residual signal producing arrangement for producing a linear prediction residual signal which is related to the input voice signal and may simply be called a prediction residual signal. More specifically, the prediction residual signal represents a liner prediction residual related to the input voice signal frame by frame.

A pulse searching arrangement 62 is different to a certain extent from the pulse searching arrangement 31 described in conjunction with FIGS. 1 through 3. Like the pulse searching arrangement 31, the pulse searching arrangement 62 is supplied with the feature parameter signal from the parameter dequantizer 23. Unlike the pulse searching arrangement 31, the pulse searching arrangement 62 is not connected directly to the main buffer memory 18 but indirectly through the inverse filter 61 to be supplied with the prediction residual signal.

In the pulse searching arrangement 62, an autocorrelator, a pulse searcher, and a search quantizer are similar to corresponding circuit elements used in the pulse searching arrangement 31 and are therefore denoted by the reference numerals 34, 44, and 45. The pulse searching arrangement 62 comprises a convolution filter 63 connected to the inverse filter 61 and to the autocorrelator 34. Controlled by the autocorrelation signal, the convolution filter 63 calculates a convolution of the linear prediction residual of the input voice signal and the autocorrelation factors to supply the pulse searcher 44 with a search cross-correlation signal representative of the convolution.

In this manner, the pulse searching arrangement 62 searches excitation pulses or sound source pulses representative of the input voice signal in each frame and supplies the search quantizer 45 with an excitation pulse signal representative of the excitation pulses searched for the input voice signal. Quantized parameter and pulse signals are delivered to the multiplexer 46 like in the voice encoder illustrated with reference to FIGS. 1 through 3.

Figure 5:
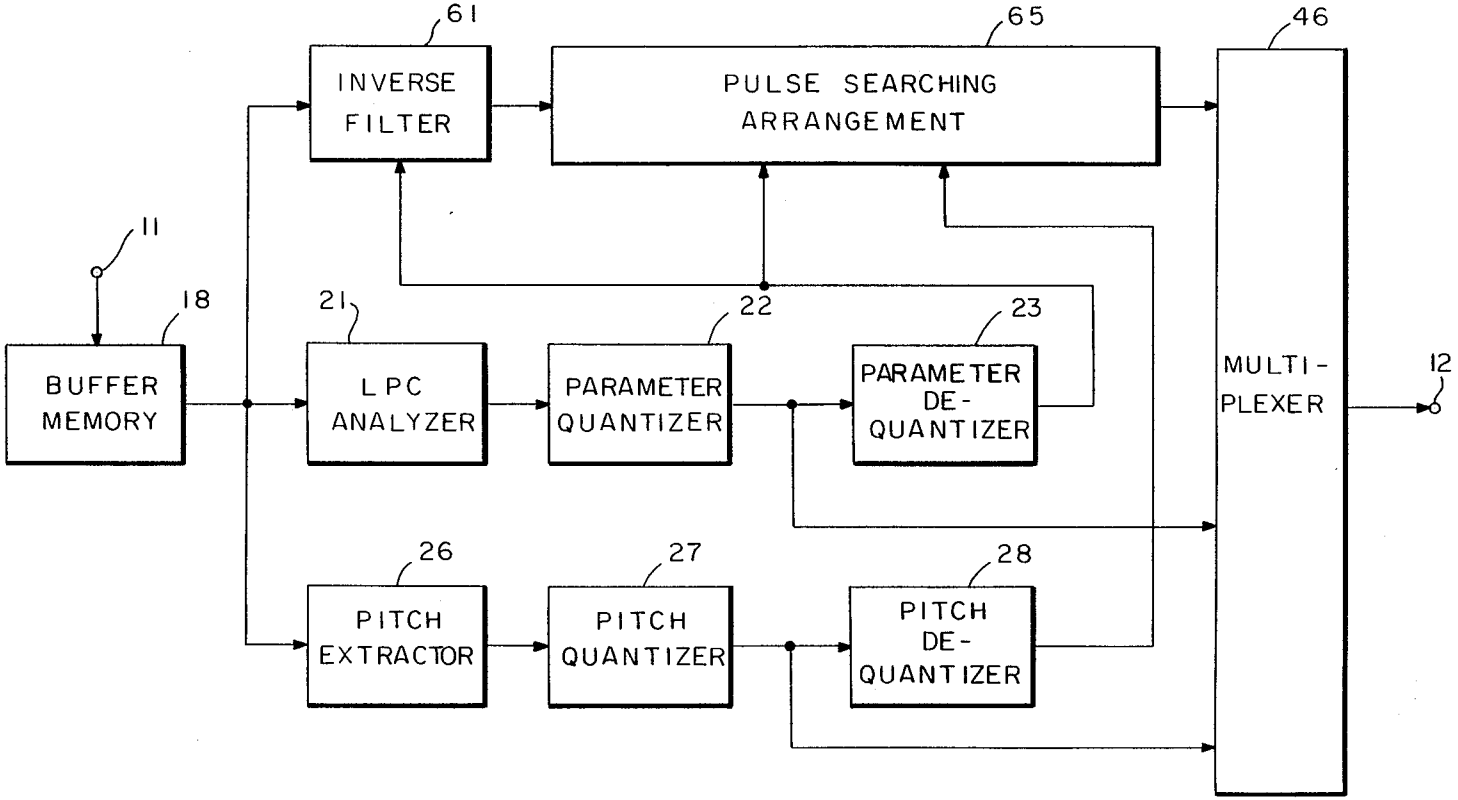
FIG. 5 is a block diagram of a voice encoder according to an embodiment of the instant invention.
Figure 6:
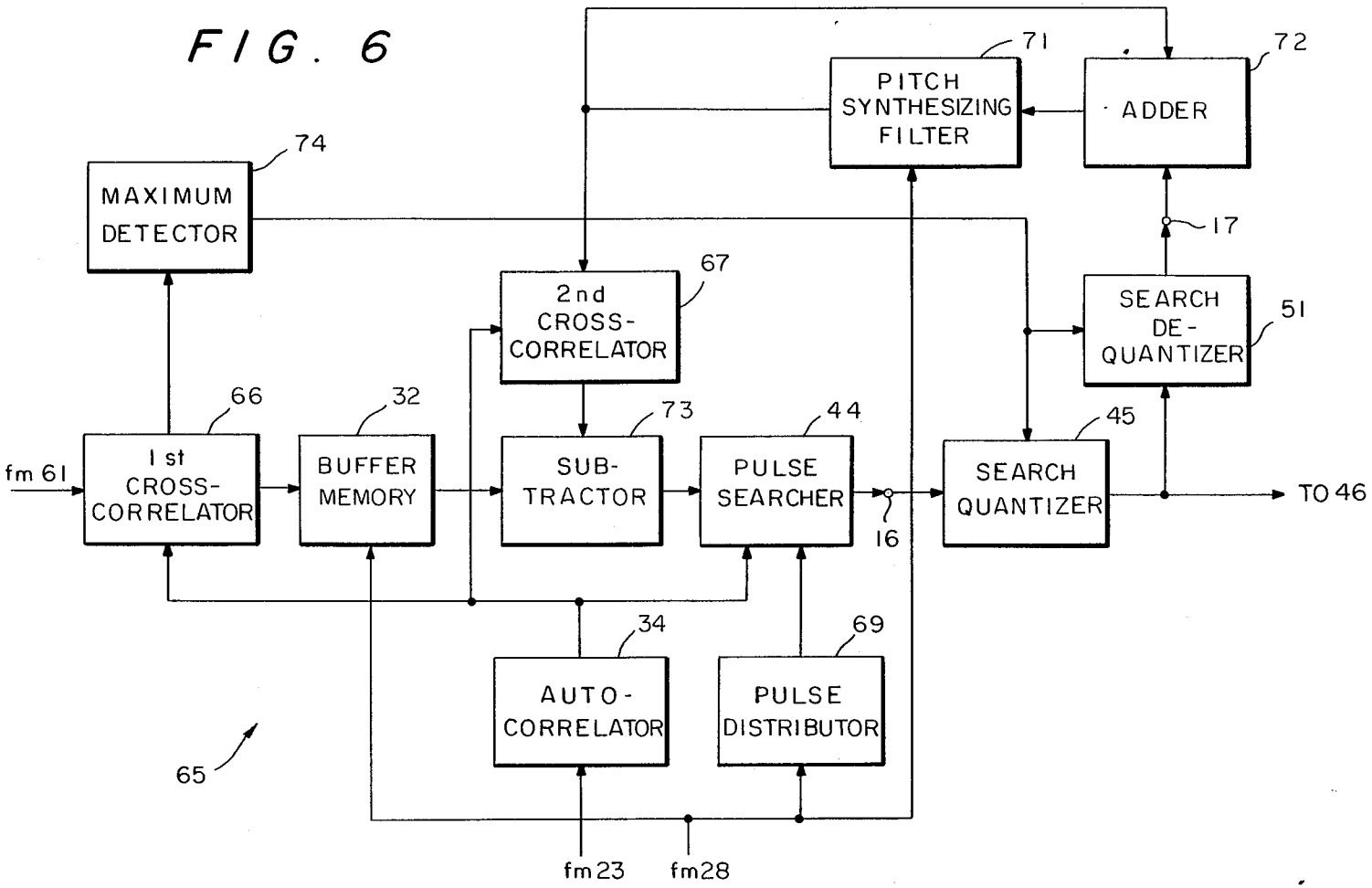
FIG. 6 is a detailed block diagram of a part of the voice encoder illustrated in FIG. 5.

Referring now to FIGS. 5 and 6, the description will proceed to a multi-pulse voice or speech encoder according to a preferred embodiment of the instant invention. The voice encoder has encoder input and output terminals 11 and 12 and first and second intermediate terminals 16 and 17 and comprises similar parts which are designated by like reference numerals and are likewise operable. It should be noted in connection with FIGS. 5 and 6 that the weighting filters, such as 36 and 42, are not depicted. The autocorrelation signal is therefore produced by the autocorrelator 34 to represent autocorrelation factors of impulse response coefficients of a simple synthesis filter.

A pulse searching arrangement 65 is different from the pulse searching arrangements 31 and 62 described in conjunction with FIGS. 1 through 4. It should be noted in connection with the pulse searching arrangement 65 that a first cross-correlator 66 is used instead of the search cross-correlator 43 described in connection with FIG. 1 and is connected to the inverse filter 61 as the convolution filter 63 and that the subsidiary buffer memory 32 is not directly connected to the main buffer memory 18 but indirectly through a combination of the inverse filter 61 and the first cross-correlator 66. Furthermore, a second cross-correlator 67 is used. Each of the first and the second cross-correlators 66 and 67 is a finite impulse response (FIR) filter having the autocorrelation signal as its impulse response and is controlled by the autocorrelation signal.

The first cross-correlator 66 produces a first cross-correlation signal representative of cross-correlation factors related to each frame of the linear prediction residual signal. The subsidiary buffer memory 32 buffers the first cross-correlation signal and produces an output cross-correlation signal representative of the first cross-correlation signal in each of the pulse search durations.

In FIG. 6, a pulse distributor 69 is supplied with the pitch period signal from the pitch dequantizer 28. Like the pulse distributing circuit comprising the circuit elements 36 through 39 described before, the pulse distributor 69 produces a pulse count signal representative of pulse counts of excitation pulses or sound source pulses which should be searched by the pulse searching arrangement 65 in the respective subframes of each frame of the input voice or speech signal. Inasmuch as the excitation pulses are distributed in each frame in the manner described in relation to the pulse distributor 39 depicted in FIG. 2, the pulse distributor 69 is readily implemented. Incidentally, it has now been confirmed that the pulse distributor 69 is excellently operable despite its simpler structure than the pulse distributing circuit.

The pulse searching arrangement 65 comprises a local signal producing circuit supplied with the linear prediction residual signal from the inverse filter 61 and with the excitation pulse signal from the second intermediate terminal 17. Inasmuch as the first and the second cross-correlators 66 and 67 are included, the local signal producing circuit is controlled by the feature parameter signal through the autocorrelator 34. In the manner which will become clear in the following, the local signal producing circuit is furthermore controlled by the pitch period signal supplied from the pitch dequantizer 28 and produces a local signal related to the prediction residual signal.

Instead of the search cross-correlation signal used in the pulse searching arrangement 31, the local signal is delivered to the pulse searcher 44. Controlled by the pulse count signal produced by the pulse distributor 69 and supplied with the autocorrelation signal, the pulse searcher 44 searches the excitation pulses in each pulse search duration to supply the first intermediate terminal 16 with the excitation pulse signal representative of the excitation pulses which are searched in the pitch periods, namely, throughout the input voice signal.

In the manner which will later be described more in detail, the local signal producing circuit comprises a pitch synthesizing filter 71 controlled by the pitch period signal supplied from the pitch dequantizer 28. Supplied with a sum signal, the pitch synthesizing filter 71 produces a synthesized signal. An adder 72 is connected to the second intermediate terminal 17 and to the pitch synthesizing filter 71 to add the excitation pulse signal and the synthesized signal into the sum signal and to deliver the sum signal to the pitch synthesizing filter 71.

The second cross-correlator 67 is supplied with the synthesized signal and calculates cross-correlation factors between the synthesized signal of a current one of the pulse search durations and the synthesized signal of a preceding one of the pulse search durations that next precedes the current one under consideration. The second cross-correlator 67 produces a second cross-correlation signal representative of the last-mentioned cross-correlation factors in each of the pulse search durations. A subtracter 73 subtracts the second cross-correlation signal from the output cross-correlation signal to produce the local signal.

Supplied with the excitation pulse signal through the first intermediate terminal 16, the search quantizer 45 delivers the quantized pulse signal to the multiplexer 46 depicted in FIG. 5. Inasmuch as the pulse searching arrangement 65 does not include the distributor pulse searcher 38 described in connection with FIGS. 1 and 2, a maximum detector 74 is supplied with the output cross-correlation signal to detect a maximum value of the cross-correlation factors related to the linear prediction residual signal in each frame. A maximum value signal representative of the maximum value is used to control the search quantizer and dequantizer 45 and 51.

Turning to FIG. 7, it will again be surmised that each frame of the input voice signal is divided into first through fourth subframes which have a common subframe period of M sampling periods. The output cross-correlation signal is exemplified along a top or first line labelled (A). The first through the fourth subframes are indicated in connection with the output cross-correlation signal at 76, 77, 78, and 79. The first and the second subframes 76 and 77 are assumed to be included in the preceding and the current ones of the pulse search durations. The impulse response length is not illustrated.

It will furthermore be assumed that the synthesized signal is produced by the pitch synthesizing filter 71 in the first subframe 76 of the preceding pulse search duration as depicted by dashed lines along a second line labelled (B) and that the synthesized signal has a wave or pulse form which is illustrated by solid lines along the second line (B). Under the circumstances, the second cross-correlation signal has a wave form which is depicted along a third line labelled (C). The local signal is shown along a fourth line labelled (D). The pulse searcher 44 produces the excitation pulses which are exemplified along a fifth line labelled (E).

The search dequantizer 51 delivers the dequantized pulse signal to the second intermediate terminal 17 with a pulse form which is substantially identical with that depicted along the fifth line (E). The sum signal is illustrated along a sixth line labelled (F). Responsive to the sum signal, the pitch synthesizing filter 71 produces the synthesized signal as depicted by the solid lines along the second line (B).

Figure 7:
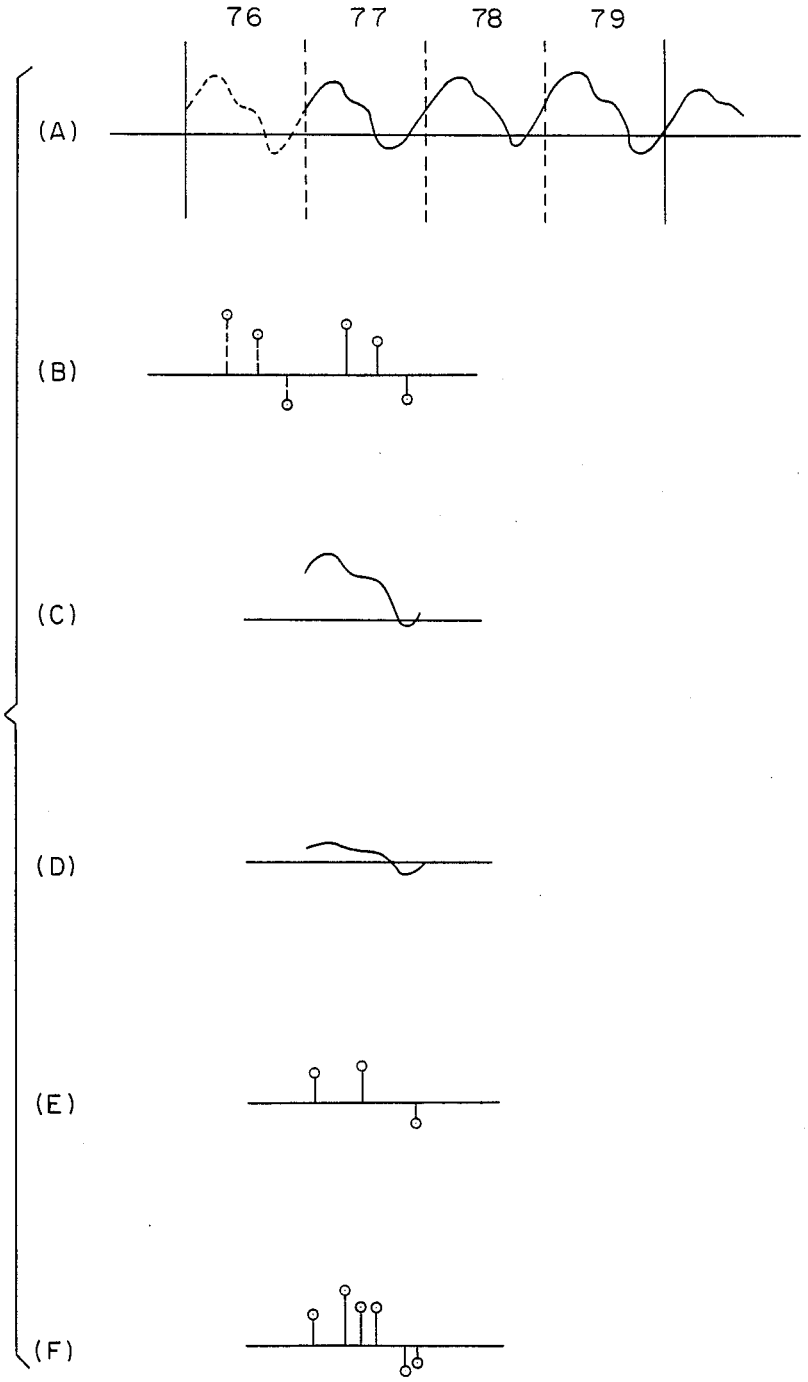
FIG. 7 shows wave forms of signals which appear in the voice encoder depicted in FIGS. 5 and 6.

Reviewing FIGS. 5 through 7, it is now understood that the local signal is obtained by removing, in a cross-correlation domain or on a cross-correlation level, the influence of the excitation pulses of the preceding pulse search duration from the output cross-correlation signal of the current pulse search duration. The pulse searching arrangement 65 therefore carries out pitch prediction in the cross-correlation domain. This makes it unnecessary for the pulse searching arrangement 65 to develop the reproduced voice signal subframe by subframe. In addition, a boundary between two consecutive frames or subframes is readily processed.

Figure 8:
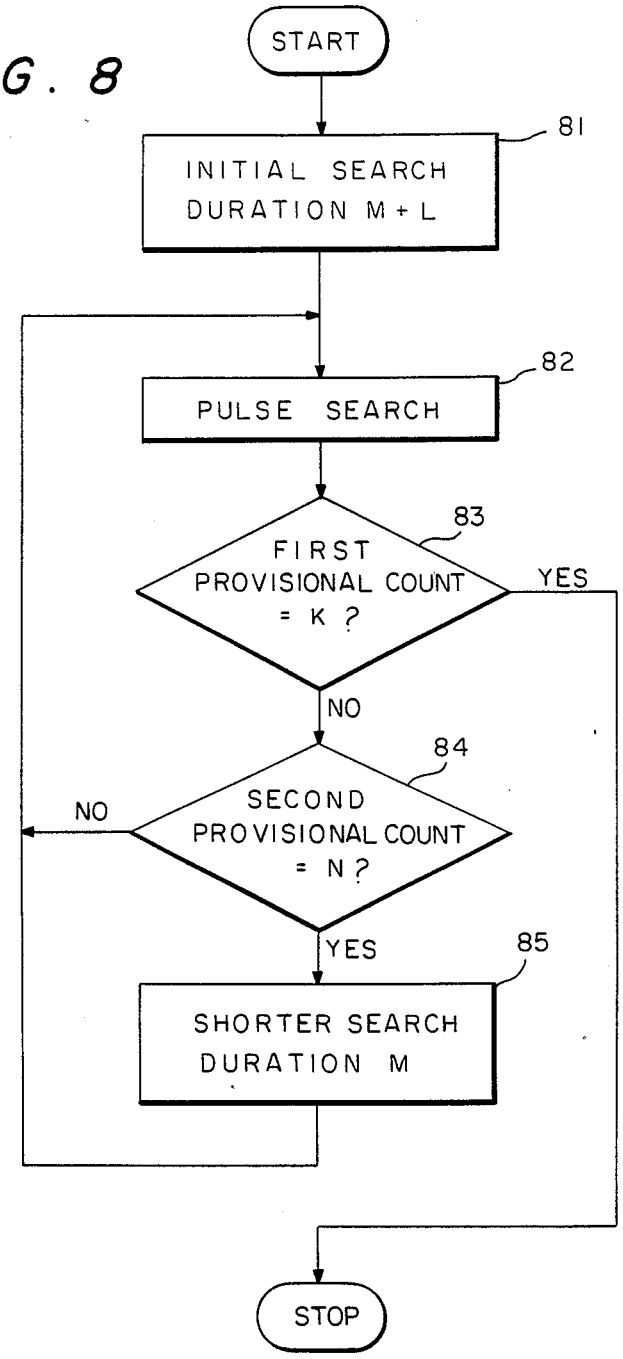
FIG. 8 is a flow chart for use in describing operation of the voice encoder shown in FIGS. 5 and 6.

Referring to FIG. 8, the pulse searcher 44 is operable as follows. It will be assumed that K excitation pulses should be searched in one of the subframes of a subframe period of M sampling periods and that N excitation pulses may be searched in the meantime in the impulse response length which is L sampling periods long and should be added to the subframe under consideration to provide one of the pulse search durations. Conveniently, the pulse count N is determined by computer simulation together with the impulse response length.

The first cross-correlation signal of the pulse search duration is read from the subsidiary buffer memory 32 and is used to supply the local signal of an initial search duration to the pulse searcher 44 at a first step 81. Pulse search is carried out at a second step 82. Whenever each of the excitation pulses is searched, the pulse searcher 44 counts a first provisional count of the excitation pulses and checks at a third step 83 whether or not the provisional count becomes equal to the pulse count K. When the provisional count reaches the pulse count K, the pulse search comes to an end.

When the first provisional count is less than the pulse count K, the pulse searcher 44 counts a second provisional count of the excitation pulses searched in the impulse response length and checks at a fourth step 84 whether or not the second provisional count amounts to the pulse count N. If the second provisional count is less than the pulse count N, the fourth step 84 returns back to the second step 82. If the second provisional count reaches the pulse count N before the first provisional count amounts to the pulse count K. the pulse searcher 44 changes at a fifth step 85 the initial search duration to a shorter search duration which is the subframe period long. The fifth step 85 is returned back to the second step 82. This astonishingly reduces the processing time for the pulse search.

While this invention has thus far been described in specific conjunction with only one preferred embodiment thereof, it will now be readily possible for one skilled in the art to carry this invention into effect in various other manners and to implement the multi-pulse voice encoder of this invention by a signal processor which typically is of the type μPD-77230 manufactured and sold by NEC Corporation, Tokyo, Japan. Weighting filters, such as 42, may be included in the voice encoder described with reference to FIGS. 5 through 8. The pulse count may be variable from subframe to subframe. Incidentally, the pulse searcher 44 operable as described with reference to FIG. 8 and the pitch synthesizing filter 71 may be implemented by a common microprocessor separately of other circuit elements of the voice encoder illustrated with reference to FIGS. 5 and 6.

What is claimed is:

1. In a voice encoder having an encoder input terminal supplied with an input voice signal and an intermediate terminal to which an excitation pulse signal is delivered to represent said input voice signal, said voice encoder comprising analyzing means for analyzing said input voice signal into feature parameters to produce a feature parameter signal representative of said feature parameters, extracting means connected to said input terminal for extracting pitch periods from said input voice signal to produce a pitch period signal representative of said pitch periods, residual signal producing means connected to said input terminal and controlled by said feature parameter signal for producing a prediction residual signal related to said input voice signal, and pulse searching means connected to said intermediate terminal and supplied with said feature parameter signal, said pitch period signal, and said prediction residual signal for searching excitation pulses representative of said input voice signal in each of pulse search durations successively determined with reference to said pitch periods, said pulse searching means thereby producing the excitation pulses in said pitch periods to deliver said excitation pulse signal to said intermediate terminal, the improvement wherein said pulse searching means comprises:

local signal producing means connected to said intermediate terminal and to said residual signal producing means and controlled by said feature parameter signal and said pitch period signal for producing a local signal related to said prediction residual signal in each of said pulse search durations; and a pulse searching circuit connected to said intermediate terminal and supplied with said feature parameter signal, said pitch period signal, and said local signal for searching said excitation pulses in said pulse search durations to deliver said excitation pulse signal to said intermediate terminal.

2. A voice encoder as claimed in claim 1, said pulse searching circuit including an autocorrelator responsive to said feature parameter signal for producing an autocorrelation signal representative of autocorrelation factors of said feature parameters, wherein:

said local signal producing means comprises:

a first cross-correlator connected to said residual signal producing means and controlled by said autocorrelation signal for producing a first cross-correlation signal representative of cross-correlation factors related to said prediction residual signal;

a buffer memory controlled by said pitch period signal for buffering said first cross-correlation signal to produce an output cross-correlation signal representative of said first cross-correlation signal in each of said pulse search durations;

a pitch synthesizing filter controlled by said pitch period signal and supplied with a sum signal for producing a synthesized signal;

an adder connected to said intermediate terminal and to said pitch synthesizing filter for adding said excitation pulse signal and said synthesized signal into said sum signal to deliver said sum signal to said pitch synthesizing filter;

a second cross-correlator controlled by said autocorrelation signal and supplied with said synthesized signal for calculating cross-correlation factors of the synthesized signal of a current one and a preceding one of said pulse search durations to produce a second cross-correlation signal representative of the last-mentioned cross-correlation factors in each of said pulse search durations; and a subtracter for subtracting said second cross-correlation signal from said output cross-correlation signal to produce said local signal;

said pulse searching circuit comprising a pulse searcher connected to said intermidiate terminal and supplied with said autocorrelation signal and said local signal for searching said excitation pulses in said pulse search durations to deliver said excitation pulse signal to said intermediate terminal.

3. A voice encoder as claimed in claim 2, each of said pulse search durations being equal to a sum of a subframe period determined by said pitch periods and an impulse response length of said analyzing means, said excitation pulses being searched in said subframe period up to a first predetermined count and in said impulse response length up to a second predetermined count, wherein said pulse searcher checks whether or not said first predetermined count is reached by a first provisional count of the excitation pulses searched in said subframe period, checks whether or not said second predetermined count is reached, before said first predetermined count is reached by said first provisional count, by a second provisional count of the excitation pulses searched in said impulse response length, and searches the excitation pulses in a shorter search duration of said subframe period if said second predetermined count is reached by said second provisional count before said first predetermined count is reached by said first provisional count.

* * * * *